United States Patent [19]

Salsetti et al.

[11] Patent Number: 4,913,455

[45] Date of Patent: Apr. 3, 1990

[54] DEVICE FOR FASTENING A BOOT TO A CROSS-COUNTRY SKI

[75] Inventors: Pascal Salsetti; Francois Jodelet, both of Voiron, France

[73] Assignee: Skis Rossignol S.A., Voiron, France

[21] Appl. No.: 317,282

[22] Filed: Feb. 28, 1989

[30] Foreign Application Priority Data

Mar. 1, 1988 [FR] France ..... 88 03074

[51] Int. Cl.[4] ..... A63C 9/02

[52] U.S. Cl. ..... 280/615

[58] Field of Search ..... 280/611, 614, 615, 631, 280/632

[56] References Cited

U.S. PATENT DOCUMENTS

| | | | |
|---|---|---|---|
| 4,309,833 | 1/1982 | Salomon | 280/615 X |
| 4,496,169 | 1/1985 | Salomon et al. | 280/615 |
| 4,647,064 | 3/1987 | Salomon et al. | 280/615 |
| 4,691,936 | 9/1987 | Nowak et al. | 280/615 |

*Primary Examiner*—Charles A. Marmor

*Assistant Examiner*—Michael Mar

*Attorney, Agent, or Firm*—Browdy and Neimark

[57] ABSTRACT

A device for fastening a boot to a cross-country ski including a stirrup having a central part articulated on a pin transverse to the ski, and branches shaped to allow fitting of a complementary part made at the front end of the boot. The stirrup is equipped with structure for immobilizing the front end of the boot, which consist of a locking lever mounted to pivot on the stirrup around a pin transverse to the ski, a catch mounted to pivot on the locking lever around a pin crosswise to the ski, comprising two fingers coming in contact with the front edges of the stirrup forming control ramps of the position of the lever, and an elastic element placed between the stirrup and the lever and acting on the latter in the closing direction, in a plane passing approximately through the pin for articulation of the catch on the lever and on both sides of which are points of contact between the catch and stirrup, respectively in an opening position and in a closing position.

9 Claims, 3 Drawing Sheets

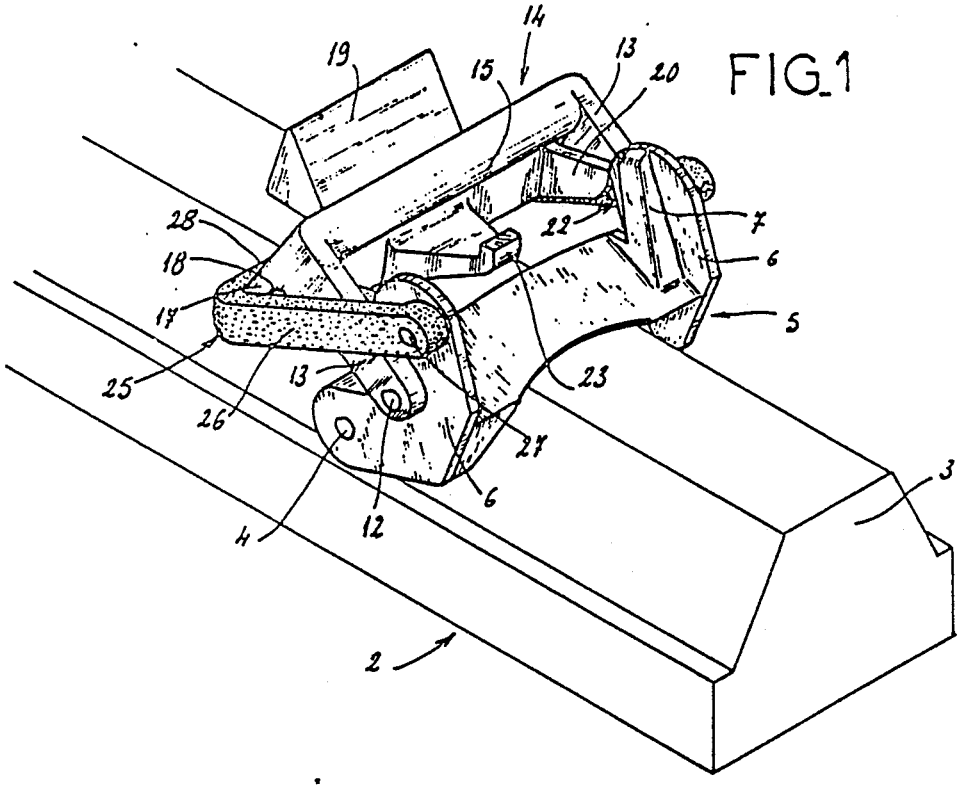
FIG. 1
FIG. 2
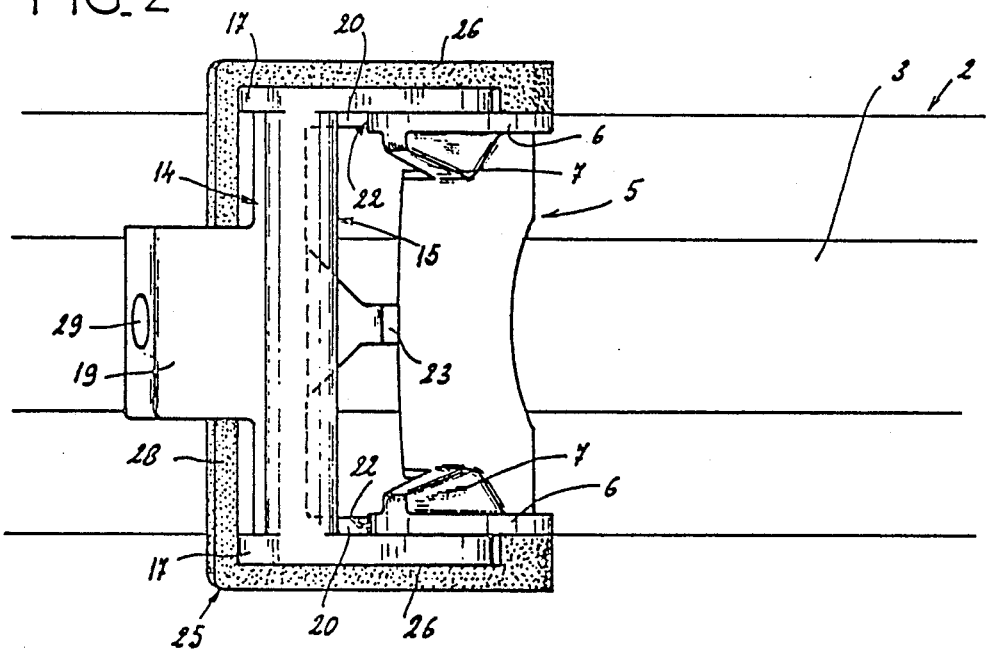

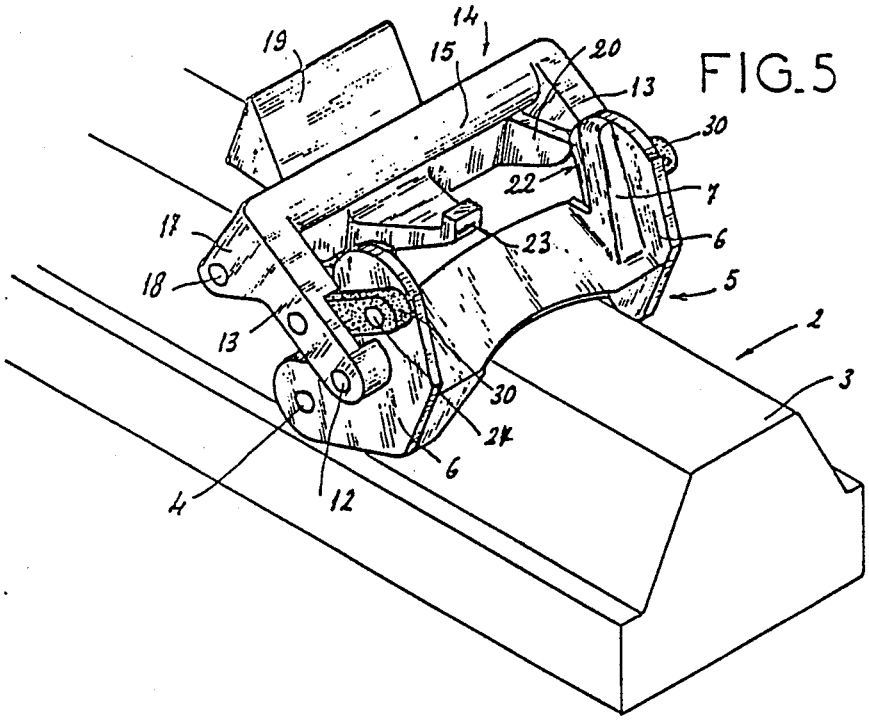
FIG. 5
FIG. 6
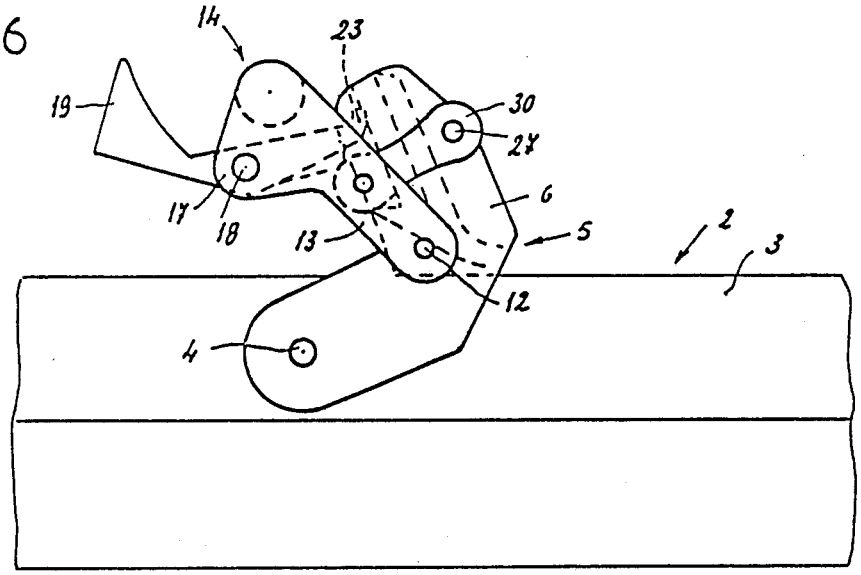

DEVICE FOR FASTENING A BOOT TO A CROSS-COUNTRY SKI

BACKGROUND OF THE INVENTION

1. Field of the Invention

This invention relates to a device for fastening a boot to a cross-country ski.

2. The Prior Art

A cross-country ski fastening comprises a stop assuring locking of the front end of the boot on the ski, while leaving the heel free, which allows the skier to raise his heels relative to the skis to perform the movement of advancing the latter.

To allow this pivoting of the boot while benefitting from a good rigidity of the boot sole, it is known, from the document EP-A-0 167 462, to make a fastening comprising a stirrup whose central part is articulated on a pin crosswise to the ski, and whose branches are shaped to allow fitting of a complementary part made at the front end of the boot. This stirrup itself is equipped with means for immobilizing the boot.

However, the locking device described in this document is relatively impractical to use, since it requires manual intervention both for closing and opening the fastening.

SUMMARY OF THE INVENTION

The present invention aims at providing a fastening device of this type, comprising improved locking means.

For this purpose, the fastening device to which it relates, of the type comprising a stirrup whose central part is articulated on a pin crosswise to the ski, and whose branches are shaped to allow fitting of a complementary part made at the front end of the boot, this stirrup further being equipped with means for immobilizing the front end of the boot, is characterized in that the immobilization means consist of:

a locking lever mounted to pivot on the stirrup around a pin crosswise to the ski between a closing position in which a part of the lever rests on the upper face of the front end of the boot and an opening position in which the lever allows free access to the stirrup, a catch mounted to pivot on the locking lever around a pin crosswise to the ski, comprising two fingers coming in contact with the front edges of the stirrup forming ramps whose profile is such that when the catch is swung forward the locking lever is in opening position and when the catch is swung backward is in closing position, and elastic means placed between the stirrup and lever and acting on the latter in the closing direction, in a plane passing approximately through the pin for articulation of the catch on the lever and on both sides of which are points of contact between the catch and stirrup, respectively in opening position and in closing position.

The movements of opening and closing the fastening are obtained by action on a single catch whose forward or backward swing causes swinging of the lever to its opening position or its closing position, respectively. These movements are performed very easily, without the unit being able to remain in a stable intermediate state, since when the catch is operated in one direction, it automatically continues its movement to the end of travel, under the action of elastic means, as soon as the support points of the catch on the stirrup have passed to the other side of the plane of action of the elastic means, relative to the side where they were initially located.

Advantageously, the catch is equipped at its lower end, with at least one finger turned toward the back and intended to rest under the front end of the part of the boot coming to fit into the stirrup.

During fitting the front end of the boot into the stirrup, the latter rests on the finger of the catch, causing a backward pivoting of the latter and consequently a pivoting of the lever to its locking position under the joint action of the elastic means. Therefore, this is a fastening which allows automatic insertion of the boots. To unlock the lever, it is sufficient to make the catch pivot forward either by hand or with the tip of the ski pole, a movement accompanied by a pivoting of the lever to its opening position, and an upward movement of the finger integral with the catch, which lifts the front part of the boot and facilitates its leaving the stirrup.

According to an embodiment of this device, the locking lever has a general U shape, whose branches are each articulated on a branch of the stirrup, and whose central part forms a support surface on the upper face of the front part of the boot. Preferably, the support surface of the lever on the upper face of the front part of the boot is in the shape of a cylindrical surface section with an axis crosswise to the ski.

This characteristic, assuring support of the lever on the boot along a generatrix of a cylindrical surface, achieves an excellent locking, regardless of the inclination of the boot upper support face, more especially since the device assures a compensation of the thickness of the boot sole by a more or less considerable swinging of the lever.

According to another embodiment of this device, the support surface of the front of the boot exhibits a cylindrical surface section with an axis crosswise to the ski and works with a lever whose support surface is plane. The characteristic will achieve the same advantages as those described above.

According to another characteristic of the invention, the front end of the lever comprises two wings delimiting, with the central part of the lever, a yoke used for mounting the hinge pin of the catch.

According to a first possibility, the elastic means consist of a part of synthetic material having a general U shape, of which the ends of the branches are mounted to pivot on the wings of the stirrup around a pin crosswise to the ski, and whose central part rests on the front face of the lever at the level of the pin for articulation of the catch on the latter.

According to another possibility, the elastic means consist of two strips of synthetic material placed parallel to the axis of the ski, whose ends are fastened, on the one hand, to the stirrup, and, on the other hand, to the lever.

According to a preferred embodiment, the catch comprises a single control finger placed on the longitudinal axis of the ski and intended to penetrate into a recess made for this purpose in the lower face of the front end of the boot. The choice of the depth of this recess makes it possible to adjust the offsettings at opening and closing between the operation of the catch and movement of putting the boot in place.

A great compactness particularly in the direction of height results from the structure of this device and particularly from the approximately horizontal arrangement of the elastic means.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

In any case, the invention will be better understood from the following description with reference to the accompanying diagrammatic drawing representing, by way of nonlimiting examples, two embodiments of this device for fastening a boot to a cross-country ski, in which FIG. 1 is a perspective view of a first device in open position;

FIG. 2 is a top view;

FIGS. 5 and 6 are two views in open position of a variant of this device, respectively, in perspective and side view.

DETAILED DESCRIPTION OF THE PREFERRED EMBODIMENT

Figure 3:
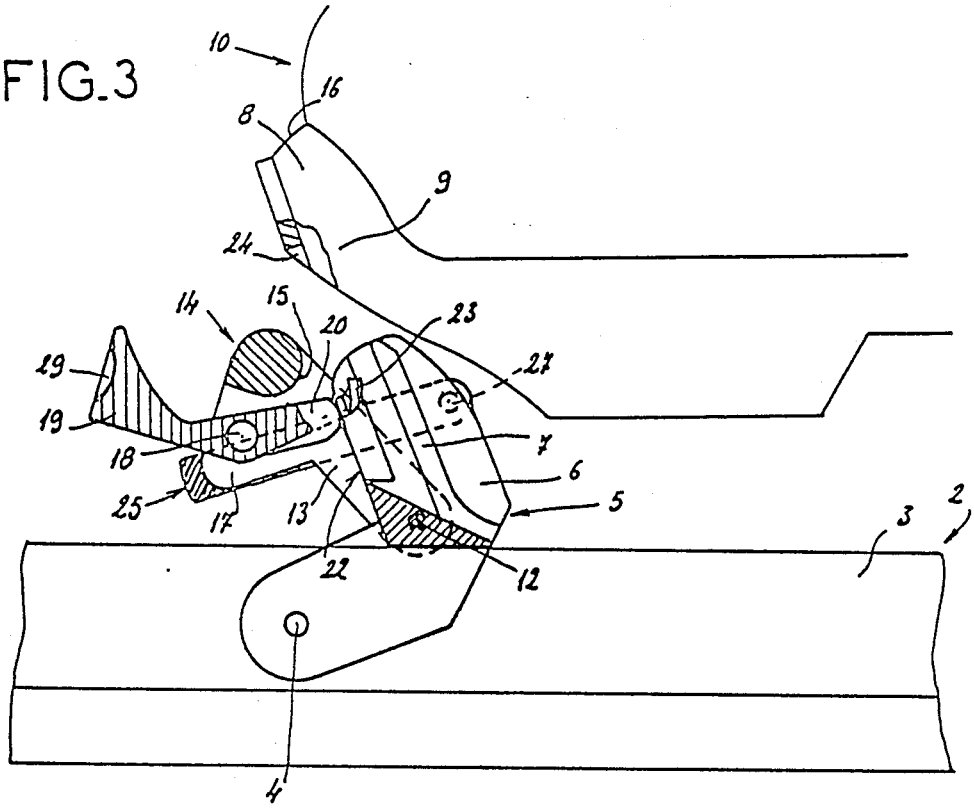
FIGS. 3 and 4 are two side views, partially in section, of this device, respectively, in open position and in locking position of the boot.
Figure 4:
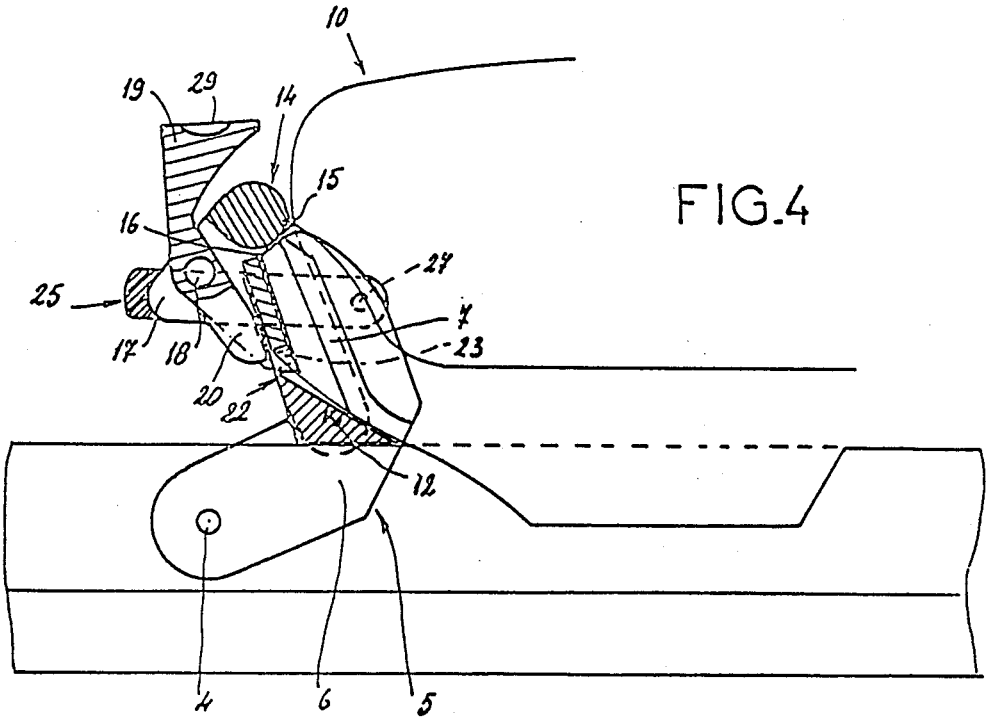

FIG. 1 represents a cross-country ski comprising, on its upper face, a longitudinal rib 3 of trapezoidal section, through which a crosswise pin 4 passes. Pin 4 is used for articulated mounting of the boot fastening device.

This device comprises a stirrup 5 comprising a central part 6' parallel to the plane of the ski and two branches 6 which are perpendicular to it, used, on the one hand, for mounting pin 4 and, on the other hand, for fastening the boot. For this purpose, branches 6 exhibit, on their opposing faces, two ribs 7 with a general vertical orientation when the stop is at rest, these ribs being used for fitting of complementary grooves 8 made at front end 9 of the sole of a boot 10.

On branches 6 of stirrup 5 are articulated, around a pin 12 crosswise to the ski, branches 13 of a lever 14 with a general U shape, whose central part comprises a support surface on upper face 16 of front part 9 of the boot, shaped as a cylindrical surface section 15.

The front end of stirrup 14 comprises two parallel wings 17, turned toward the front, used for mounting, crosswise to the ski, of a rotation pin 18 of a catch 19 This catch 19 comprises two fingers 20 turned toward the rear, resting against front edges 22 of the two branches of the stirrup, which form guide ramps. The length of fingers 20 and the profile of edges 22 are such that, when catch 19 is swung forward, it carries lever 14 into the opening position and when catch 19 is swung backward, it carries lever 14 toward the closing position.

The catch is equipped, in its central part and at its lower end, with a finger 13 turned toward the rear. Finger 13 is intended, during fastening of the boot to the ski, to come to rest on the bottom of a recess 24 coming out in the lower face of the front end 9 of the boot.

In the device represented in FIGS. 1 to 4, the elastic means consist of a part 25 made of synthetic material with a general U shape of which the ends of branches 26 are mounted on branches 6 of the stirrup with the possibility of pivoting around a pin 27 transverse to longitudinal axis of the ski, and whose central part 28 rests on lever 14 at the level of pin 18 for articulation of catch 19 on the latter. Pin 27 is placed so that the plane of action of the elastic means is located between the points of contact of fingers 20 on ramps 22 of the stirrup, respectively, in the open and closed position of the fastening.

The functioning of this device is as follows.

To fasten boot 10 on the ski, it suffices for the user to present his boot above the device which is in open position as shown in FIG. 3. The boot is then moved downward to engage grooves 8 on ribs 7 of stirrup 5, a movement during which the front end of the boot rests on finger 23 of catch 19. This resting causes a backward swinging of catch 19 and, consequently, of locking lever 14, this movement being promoted by the action of elastic means 25 as soon as the point of support of fingers 20 on ramps 22 has gone to the other side of the plane of the elastic means. Elastic means 25 assures holding the device in the locking position, represented in FIG. 4, this locking being obtained by resting of cylindrical surface 15 of lever 14 against upper face 16 of the front part of the boot.

To loosen the boot from the ski, it suffices for the user to make the catch swing forward, for example, by resting the tip of a ski pole in a recess 29 made in catch 19. Pivoting of catch 19 is reflected by a pivoting of lever 14 to its opening position and by an upward pivoting of finger 23, which thus achieves a ejection of the boot from the fastening. The end of this movement is promoted by the passage to the other side of the plane of action of the elastic means 25, which also assure holding of the device in open position.

FIGS. 5 and 6 represent a variant embodiment of the device in which the same elements are designated by the same references as above, the only difference being the fact that the elastic means consist not of a part in the shape of a stirrup encircling the front part of the locking lever, but of two strips 30 of synthetic material placed parallel to the longitudinal axis of the ski, whose ends are fixed, on the one hand, to branches 6 of stirrup 5 and, on the other hand, to branches 13 of lever 14.

The functioning of this device is exactly the same as that of the device described above.

As comes out from the above, the invention contributes a great improvement of the existing art by providing a device for fastening a boot to a ski, of simple design, of a great compactness and very practical use, since allowing an automatic putting in the boot and ejection of the boot during removal of the boot.

Of course, the invention is not limited to the sole embodiments of this device, described above by way of examples; rather, it takes in all the variant embodiments. Thus, particularly this device could be mounted not on a ski with a longitudinal rib but on a ski of rectangular section or also the catch need not comprise one central control finger but two lateral control fingers without thereby going outside the framework of the invention.

Thus elastic means 25 could consist of a torsion bar acting at the same time as a pin 12, or also a kickover spring acting between lever 14 and stirrup 15, or also by any other mechanically known means.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A device for fastening a boot to a cross-country ski having a stirrup with a central part and two branches articulated on a first pin extending transverse to the ski, and whose branches are shaped to allow fitting of a complementary front part located at the front end of the boot, said device comprising:

means for immobilizing a front end of the boot provided on the stirrup, the means for immobilizing comprising:

a locking lever mounted to pivot on the stirrup around a second pin extending transverse to the ski between a closed position in which a part of the lever rests upon the upper face of the front part of the boot and an opened position in which the lever allows free access to the stirrup;

a catch mounted to pivot on the locking lever around third pin means extending transverse to the ski, said catch including two fingers for engaging guide ramps formed along the front edges of the branches of said stirrup, said guide ramps having a profile such that when the catch is swung forward the locking lever is carried into the opened position and when the catch is swung backward the locking lever is carried into the closed position and means upon which the front part of the boot rests when received within the stirrup; and elastic means placed between the stirrup and the lever and acting on the lever for biasing the lever towards the closed position, said elastic means extending in a plane passing approximately through the third pin means for articulation of the catch on the lever, the points of contact between the fingers of said catch and the guide ramps of said stirrup being located on both sides of said plane when said locking lever is in said respective opened and closed positions.

2. A device according to claim 1, wherein said means upon which the front part of the boot rests when received within the stirrup includes at least one finger extending rearwardly from the lower end of the catch.

3. The device according to claim 1, wherein the locking lever has a general U shape, and includes branches a part of which forms a support surface on an upper face of the front end of the.boot.

4. The device according to claim 3, wherein the support surface of the lever which rests upon the upper face of the front part of the boot is in the shape of a cylindrical surface section with an axis extending transverse to the ski.

5. The device according to claim 1, wherein a front end of locking lever comprises two wings delimiting, with the central part of the lever, a yoke used for mounting the third pin means.

6. The device according to claim 1, wherein the elastic means consist of a part made synthetic material with a general U shape having two branches with ends mounted to pivot on the branches of the stirrup around fourth pin means extending transverse to the ski, and a central portion resting on a front face of the lever at the level of said third pin means for articulation of the catch on the lever.

7. The device according to claim 1, wherein the elastic means consist of two strips of synthetic material placed parallel to the axis of the ski, said strips having first ends which are fastened to the stirrup, and second ends fastened to the lever.

8. The device according to claim 1, wherein the elastic means consist of a torsion bar acting as a rotation pin between the lever and the stirrup.

9. The device according to claim 2 wherein said at least one finger comprises a single control finger centered on the longitudinal axis of the ski and shaped to penetrate into a recess made for this purpose in the lower face of front part of the boot.

* * * * *